United States Patent [19]

Frank

[11] Patent Number: 4,502,856

[45] Date of Patent: Mar. 5, 1985

[54] VANE PUMP WITH SPRING SEALING ELEMENTS AGAINST THE VANE FACES

[75] Inventor: Rüdiger Frank, Gerlingen, Fed. Rep. of Germany

[73] Assignee: Robert Bosch GmbH, Stuttgart, Fed. Rep. of Germany

[21] Appl. No.: 503,106

[22] Filed: Jun. 10, 1983

[30] Foreign Application Priority Data

Sep. 25, 1982 [DE] Fed. Rep. of Germany ..... 3235581

[51] Int. Cl.[3] ..... F04C 2/00; F04C 15/00; F16J 15/32

[52] U.S. Cl. ..... 418/137; 418/178; 418/241; 277/65

[58] Field of Search ..... 418/136, 137, 178, 241; 267/158; 277/65, 212 F, 236

[56] References Cited

U.S. PATENT DOCUMENTS

| | | | |
|---|---|---|---|
| T930,007 | 1/1975 | Takahashi et al. | 418/178 |
| 1,848,754 | 3/1932 | Lanzerotti-Spina | 418/136 |
| 2,076,536 | 4/1937 | Bateman | 418/241 |
| 3,044,687 | 7/1962 | Davey | 418/178 |
| 3,902,830 | 9/1975 | Maeda | 418/178 |
| 4,055,205 | 10/1977 | Withoff et al. | 277/212 F |

FOREIGN PATENT DOCUMENTS

| | | | |
|---|---|---|---|
| 278548 | 10/1930 | Italy | 418/137 |

*Primary Examiner*—John J. Vrablik
*Attorney, Agent, or Firm*—Edwin E. Greigg

[57] ABSTRACT

A vane pump having a cylindrical drum which revolves in a fixed housing part about an axis extending eccentrically to the housing part. The cylindrical drum drives at least one vane which is rotatably supported in the center of the fixed housing part so that the vane passes through an opening in the wall of the cylindrical drum to the inner surface of the housing part. Spring parts are disposed as sealing elements in the vicinity of the opening and are secured on each side of the vane on the cylindrical drum. At a distance from the fastening location, lip sections bent outward in convex fashion toward the vane so that the spring parts press against the respective associated outer faces of the vane for forming a seal, and also for centering the vane inside the opening when the pump is shut off. The spring parts effect reliable sealing of the opening gaps in every operational state of the pump, and they furthermore effect good removal of the heat generated by the friction between the vane and the spring parts at either side of the vane. The lip sections and/or the surfaces of the vane engaged by them have a wear-resistant coating. The sealing means are simple, inexpensive and functionally reliable.

21 Claims, 1 Drawing Figure

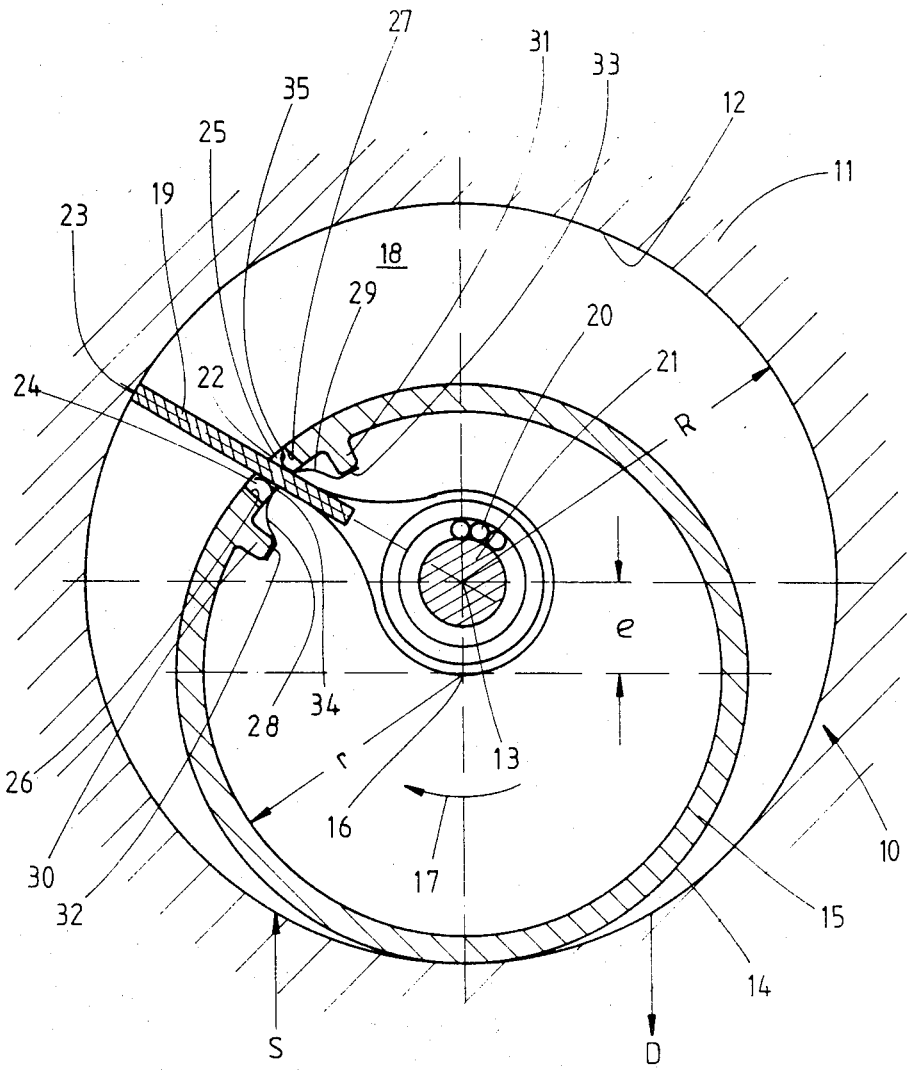
27
31
33
35
12
25
11
19
23
18
29
20
21
24
22
R
e
28
34
r
13
26
16
10
30
17
32
15
14
S
D

VANE PUMP WITH SPRING SEALING ELEMENTS AGAINST THE VANE FACES

BACKGROUND OF THE INVENTION

The invention is directed to a vane pump which uses at least one vane in combination with spring type sealing elements. A vane pump of this general type is known in which the sealing elements have on the one hand sealing strips an on the other particular spring elements, by means of which pressure is exerted against the sealing strips. Sealing elements of this kind are of relatively high expense, and they are complicated and costly.

OBJECT AND SUMMARY OF THE INVENTION

The vane pump according to the invention has the advantage over the prior art that by using spring parts as sealing elements, sealing is attained with simple and economical sealing means, and long-term sealing which is functionally reliable is assured. During operation, the vane presses the lip section of one spring part, depending upon the direction in which the pump is driven, against the associated surface of the opening, so that the gap located on that side is closed and remains closed, and reliable sealing is thus assured. On the other side, the spring part adjusts itself accordingly and rests in an elastically yielding manner with its lip element on the vane, so that the gap is closed and remains closed. Furthermore good conduction of the heat of friction away from the vane, caused by friction between the spring parts on the one hand and the surfaces of the vane engaged by them on the other, is assured.

By means of the characteristics disclosed herein, advantageous further embodiments of and improvements to the vane pump disclosed are possible.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing is a schematic section taken through the housing and rotor of a vane pump in accordance with the invention.

DESCRIPTION OF THE PREFERRED EMBODIMENT

A vane pump 10, shown only schematically in the drawing, has a stationary outer housing part 11 having an internal cylindrical bore 12, the central axis of which is marked 13 and the radius of which is marked R. Inside the cylindrical bore 12 is an inner housing part 14, which in this case represents the rotor which is embodied as an internally hollow cylindrical drum 15. The rotor is eccentric with respect to the axis of the housing and is supported such that the rotor is rotatable about its central axis at 16. The rotor is driven, for instance, such that it revolves clockwise as indicated by the arrow 17. The inside radius of the cylindrical drum 15 or rotor is marked r. The central axis 16 of the cylindrical drum 15 is disposed eccentrically, having the eccentricity e with respect to the central axis 13 of the outer housing part 11.

The cylindrical bore 12 of the outer housing part 11, and the outer surface of the cylindrical drum 15 together define a work chamber 18, which in the disposition described herein is approximately crescent-shaped. The cylindrical drum 15 forms a seal with the cylindrical bore with its outer surface resting at the bottom as seen in the drawing on the wall of the cylindrical bore 12, the result being a division of the work chamber 18 as shown. In the direction of rotation indicated in the drawing by the arrow 17, the chamber 18 is divided into a suction chamber on the left and a compression chamber on the right. This is indicated only schematically, with an exertion of force on the vane pump 10 from outside, by the arrows "S" for "suction" and "D" for "pressure", which symbolize the fact that the medium which is to be pumped is delivered and carried away in these respective regions.

The work chamber 18 is subdivided by at least one vane 19. The vane 19 is rotatably supported by means of a bearing 20 on a bearing tang 21, which extends coaxially wih the central axis 13 and is disposed in fixed fashion in the center of the outer housing part 11. The vane 19 thus extends radially with respect to the cylindrical bore 12 so that its outer end is in contact with the surface of the bore 12; the vane is driven by the cylindrical drum 15 rotating about the central axis 16. The cylindrical drum 15 has an opening 22 in its jacket, through which the vane 19 passes and extends to the outside of the drum to the surface of the bore 12. At the radially outward end of the vane, with which the vane 19 travels on the wall of the cylindrical bore 12, the vane 19 may be provided with a seal 23.

In the vicinity of the opening 22, sealing elements effect a sealing of the gaps 24, 25, which are formed between the vane 19 on the one hand and the various associated faces 26 and 27 of the opening on the other.

In a specialized embodiment, these sealing elements are embodied as spring parts 28, 29 secured to the cylindrical drum 15 at either side of the vane 19. The spring parts 28, 29 are of sheet metal, for instance, and in particular are of spring steel. Each spring part 28, 29 is embodied as a strip corresponding to the width of the vane 19 and of the opening 22. Each spring part 28, 29 is a one-piece shaped bracket, and each one, if viewed by itself, has a contour that approximates the outline of an ear.

In its interior, spaced apart at either side of the opening, the cylindrical drum 15 has inwardly pointing, rib-like protrusions 30, 31, to each of which the associated spring part 28 or 29 is secured with a respective fastening section 32 or 33. The spring parts 28, 29 are provided, spaced apart from these fastening sections 32, 33, with respective lip sections 34 and 35, which are each embodied as curved parts having a convex curvature oriented toward the associated outer surface of the vane 19. With these lip sections 34, 35, the spring parts 28, 29 press in an elastically yielding manner against the associated outer surface of the vane 19, sealing off the respective gap 24, 25. When the vane pump 10 shuts off, the spring parts 28, 29 center the vane 19 inside the opening 22. As can be seen from the drawing, the spring parts 28, 29 protrude, beginning with their fastening sections 32, 33, all the way into the opening 22. One effect of the curved form of each lip section 34, 35 is that there is only a very narrow contact surface, theoretically only along a line, between the associated outer surface of the vane 19 on the one hand and the outermost part on the curve of the lip section 34 or 35 on the other. Since these curved lip sections 34, 35 protrude into the opening 22, each lip section 34 or 35 can rest against and be supported on the associated surface 26 or 27 of the opening with a peripheral part of the lip section terminating the curve—that is, with either the peripheral part on the free end or with the other peripheral part of the curved part—as is shown particularly in the drawing, at the instant position of the vane pump 10, for the spring part 28 on the left in the drawing. As a result of this support, the additional spring capacity of the lip section 34 or 35 which can be said to be stored up in the curve is called upon for centering and especially for sealing purposes.

The spring effect of each spring part 28, 29 is also increased by the provision that the particular padrt of each spring part 28, 29 which extends between the fastening section 32 or 33 on the one hand and the lip section 34 or 35 on the other can be deflected freely without contacting anything. Very roughly described, it extends like the hypotenuse of a triangle between the protrusions 30, 32 and the associated inner edge of the opening 22 of the cylindrical drum 15.

In order to reduce wear, each spring part 28, 29 is provided on the contact surface of its lip sections 34 and 35 with a highly wear-resistant surface, in particular an appropriate coating, which for the sake of simplicity is not particularly shown in the drawing. Instead, or in addition, the vane 19 may also be provided in the vicinity of its outer surface which is engaged by these associated lip sections 34, 35 with a corresponding, highly wear-resistant surface, in particular a coating of such a kind.

Upon the rotation of the cylindrical drum 15 in the direction of the arrow 17, the vane 19 presses in the vicinity of the opening 22 with its left surface as seen in the drawing against the lip section 34 for the left spring part 28, as a result of which sealing is effected between the vane 19 and the lip section 34. By means of this pressure, the lip section 34 is also pressed against the surface 26 of the opening 22. In this manner, the gap 24 located at the left of the vane 19 is reliably closed and sealed off. On the other side of the vane 19, the spring part 29 at that location adjusts elastically in a corresponding manner and closes the gap 25 there in the same manner. Reliable and long-term sealing is thereby attained in every operating state of the vane pump 10, even at such a time as the rotational direction may, for instance, be reversed, in that case being counterclockwise, opposite from the arrow 17. The sealing which is attained is thus not dependent upon the rotational direction. A further advantage is that the heat which is created by friction between the lip sections 34, 35 of the spring parts 28 and 29 on the one hand and the parts of the vane 19 engaged by them on the other is reliably conducted away from this location. The sealing effected by means of the spring parts 28, 29 has the further advantage of improved function as well as the advantage that the embodiment is simple, requires fewer individual parts and requires relatively little effort and cost.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A vane pump hacving an outer housing part with an inner bore, an inner housing part disposed eccentrically within said inner bore of said outer housing part and rotatable about an axis therein, which together define a work chamber, at least one radially extending vane within the inner housing part, said at least one radial vane passes through an opening in the inner housing part and protrudes into the work chamber in sealing engagement with said inner bore, sealing elements disposed in the vicinity of said opening in said inner housing and positioned to produce a spring force between the at least one vane and the inner housing part forming said opening, wherein the sealing elements are embodied as curvilinear spring elements which are secured on each side of the vane and supported on the inner housing part at a fastening location, said curvilinear spring elements including a lip section at a distance from the fastening location which presses against the associated outer face of the vane in a yielding, elastic manner effectively sealing the vane inside the opening and centering the vane upon the shutdown of the pump.

2. A vane pump as defined by claim 1, characterized in that the curvilinear spring elements (28, 29) protrude, beginning at their fastening locations (32, 33), all the way into the opening (22).

3. A vane pump as defined by claim 2, in which the lip sections are embodied as curved parts having a convex curvature toward the associated outer face of the vane.

4. A vane pump as defined by claim 3, in which each curved part of said lip section can rest and be supported on the associated face of the opening in said inner housing part with at least one peripheral part terminating the curve.

5. A vane pump as defined by claim 1 in which each curvilinear spring element is embodied as a one-piece, shaped bracket having a contour with at least one divergent end portion.

6. A vane pump as defined by claim 2 in which each curvilinear spring element is embodied as a one-piece, shaped bracket having a contour with at least one divergent end portion.

7. A vane pump as defined by claim 3 in which each curvilinear spring element is embodied as a one-piece, shaped bracket having a contour with at least one divergent end portion.

8. A vane pump as defined by claim 4 in which each curvilinear spring element is embodied as a one-piece, shaped bracket having a contour with at least one divergent end portion.

9. A vane pump as defined by claim 1 in which the inner housing part is embodied as a cylindrical drum (15) having an exterior surface and an interior surface, said interior surface has protrusions thereon which are spaced apart at either side of the opening therein, a respective spring part is secured with a fastening section which is disposed on the end remote from the lip section to one each of said protrusions.

10. A vane pump as defined by claim 2 in which the inner housing part is embodied as a cylindrical drum (15) having an exterior surface and an interior surface, said interior surface has protrusions thereon which are spaced apart at either side of the opening therein, a respective spring part is secured with a fastening section which is disposed on the end remote from the lip section to one each of said protrusions.

11. A vane pump as defined by claim 3 in which the inner housing part is embodied as a cylindrical drum (15) having an exterior surface and an interior surface, said interior surface has protrusions thereon which are spaced apart at either side of the opening therein, a respective spring part is secured with a fastening section which is disposed on the end remote from the lip section to one each of said protrusions.

12. A vane pump as defined by claim 4 in which the inner housing part is embodied as a cylindrical drum (15) having an exterior surface and an interior surface, said interior surface has protrusions thereon which are spaced apart at either side of the opening therein, a respective spring part is secured with a fastening section which is disposed on the end remote from the lip section to one each of said protrusions.

13. A vane pump as defined by claim 5 in which the inner housing part is embodied as a cylindrical drum (15) having an exterior surface and an interior surface said interior surface has protrusions thereon which are spaced apart at either side of the opening therein, a respective spring part is secured with a fastening section which is disposed on the end remote from the lip section to one each of said protrusions.

14. A vane pump as defined by claim 6 in which the inner housing part is embodied as a cylindrical drum (15) having an exterior surface and an interior surface said interior surface has protrusions thereon which are spaced apart at either side of the opening therein a respective spring part is secured with a fastening section which is disposed on the end remote from the lip section to one each of said protrusions.

15. A vane pump as defined by claim 7 in which the inner housing part is embodied as a cylindrical drum (15) having an exterior surface and an interior surface said interior surface has protrusions thereon which are spaced apart at either side of the opening therein a respective spring part is secured with a fastening section which is disposed on the end remote from the lip section to one each of said protrusions.

16. A vane pump as defined by claim 8 in which the inner housing part is embodied as a cylindrical drum (15) having an exterior surface and an interior surface said interior surface has protrusions thereon which are spaced apart at either side of the opening therein a respective spring part is secured with a fastening section which is disposed on the end remote from the lip section to one each of said protrusions.

17. A vane pump as defined by claim 9, in which the part of the spring part which extends between the fastening section and the lip section can be deflected freely and without contacting anything.

18. A vane pump as defined by claim 1 in which each spring part is made of sheet metal, preferably spring steel.

19. A vane pump as defined by claim 1 in which each spring part has a highly wear-resistant surface, on the surface of the lip sections in contact with said at least one vane.

20. A vane pump as defined in claim 1 in which said at least one vane has a highly wear resistant surface which engages with said lip section of said spring parts.

21. A vane pump as defined by claim 1 in which the inner housing part, is driven so that it revolves relative to the fixed outer housing part and that said at least one vane is rotatably supported on a bearing tang inside the cylindrical drum coaxially therewith and is driven in a revolving manner by the cylindrical drum.

* * * * *